United States Patent [19]

Kagomoto

[11] Patent Number: 4,627,409

[45] Date of Patent: Dec. 9, 1986

[54] COOKING APPLIANCE OF HOT AIR CIRCULATION TYPE

[75] Inventor: Yoshiteru Kagomoto, Kashihara, Japan

[73] Assignee: Matsushita Electric Industrial Co., Ltd., Kadoma, Japan

[21] Appl. No.: 782,607

[22] PCT Filed: Apr. 13, 1983

[86] PCT No.: PCT/JP83/00112

§ 371 Date: Dec. 9, 1983

§ 102(e) Date: Dec. 9, 1983

[87] PCT Pub. No.: WO83/03658

PCT Pub. Date: Oct. 27, 1983

Related U.S. Application Data

[63] Continuation of Ser. No. 562,591, Dec. 9, 1983, abandoned.

[30] Foreign Application Priority Data

Apr. 14, 1982 [JP] Japan ..... 57-62727
Jul. 22, 1982 [JP] Japan ..... 57-128785

[51] Int. Cl.[4] ..... F24C 15/32

[52] U.S. Cl. ..... 126/21 A; 126/21 R; 126/19 R; 219/400

[58] Field of Search ..... 126/21 A, 21 R, 19 R; 219/10.55 R, 10.55, 10.67, 390, 400

[56] References Cited

U.S. PATENT DOCUMENTS

| | | | |
|---|---|---|---|
| 3,710,775 | 1/1973 | Tamada et al. | 126/21 A |
| 4,109,636 | 8/1978 | Burge | 126/21 A |
| 4,395,233 | 7/1983 | Smith et al. | 126/21 A |

FOREIGN PATENT DOCUMENTS

| | | | |
|---|---|---|---|
| 545433 | 3/1956 | Belgium | 126/21 A |
| 1515884 | 1/1968 | France | 126/21 A |
| 2093181 | 7/1979 | Japan . | |
| 42028 | 4/1981 | Japan | 126/21 A |

*Primary Examiner*—Larry Jones
*Attorney, Agent, or Firm*—Spencer & Frank

[57] ABSTRACT

A hot-air circulation type cooking appliance comprising a partition plate separating a heating chamber from a compartment storing a fan. The partition plate is provided with hot air blow-out ports divided into right and left groups, a control wall for controlling the blowing direction of hot air is provided adjacent the hot air blow-out ports while a bypass passage for hot air continuous with the control wall is provided to set the blowing direction of hot air substantially to the middle of the heating chamber so as to avoid differences in temperature between the middle and peripheral regions of the heating chamber. The invention is particularly effective for multistage cooking.

4 Claims, 11 Drawing Figures

COOKING APPLIANCE OF HOT AIR CIRCULATION TYPE

This application is a continuation, of application Ser. No. 562,591, filed Dec. 9, 1983, now abandoned.

TECHNICAL FIELD

The present invention relates to a deflecting device for deflecting the blowing direction of hot air for a cooking appliance of the hot air circulation type equipped with a hot air circulation fan for forcibly circulating hot air within a heating chamber.

BACKGROUND OF THE INVENTION

A conventional cooking appliance of the hot air circulation type comprises a heating chamber for receiving a heating load, a heating device for heating said heating chamber, a compartment adjacent to said heating chamber, a fan housed in said compartment for circulating hot air through said heating chamber and said compartment, and a partition plate separating said compartment from said heating chamber and having blow-out ports and suction ports for circulating said hot air. A concrete example of such appliance is shown in FIGS. 1–3.

FIG. 1 is a side view, in section, of a conventional gas cooking appliance of the hot air circulation type. FIG. 2 is a front view, insection, of said appliance. FIG. 3 is a plan view, in section, of said appliance. A partition plate 2 at the back of a heating chamber 1 is provided with suction ports 3 disposed substantially in the middle and blow-out ports 4 disposed in the right and left peripheral regions. There is provided a compartment 8 having the partition plate 2, a combustion chamber 5, a circulation air heating chamber 6, and a circulation fan storing chamber 7. The combustion chamber 5 is positioned below the compartment 8 and is provided in the lower portion of its peripheral wall with an inlet port 9 for combustion air, is formed in its top wall with a combustion gas passage 10 opening to the circulation air heating chamber 6 and stores two main burners 11 and a pilot burner 12. The circulation air heating chamber 6 is formed so that its partition wall 8 surrounds the suction ports 3 of the partition plate 2, and it is bored with a suction part 14 opposed to the suction side of a circulation fan 13 installed in the circulation fan storing chamber 7. The right and left side walls of the circulation fan storing chamber 7 and the partition wall 8 extend to the partition plate 2, forming a blow-out line 15 for hot air communicating with the heating chamber 1.

In the arrangement described above, the hot air flowing out of the heating chamber 1 through the suction ports 3 formed substantially in the middle of the partition plate 2 and the combustion gas at high temperature from the burners 11 passing through the combustion gas passage 10 flow into the circulation air heating chamber 6 and are sucked by the circulation fan 13 through the suction port 14 to flow into the blow-out line 15. The two hot flows are sufficiently mixed by the combining and mixing action in this suction and blow-out process and by the stirring action of the circulation fan 13, thereby providing a hot air flow at high temperature and uniform in temperature throughout. The hot air flow at high temperature moves along the side wall of the circulation fan storing chamber 7 and is blown out into the heating chamber 1 through the blow-out ports 4, as shown in FIG. 3. Since the blow-out ports 4 are located adjacent the side walls of the heating chamber 1, the hot air flow blowing into the heating chamber 1 through the blow-out ports 4 moves along the side wall of the heating chamber 1, striking a door 16 and joining the other hot air flow, with the joint flow passing substantially through the middle of the heating chamber 1 and being sucked through the suction ports 3. Heating loads 18 placed on the peripheral regions of trays 17 are subjected directly to the hot air flow at high temperature passing out of the blow-out ports 4, so that they are liable to be overheated. Heating loads 18 placed on the middle regions of the trays 17 are heated by the hot air flow after heating the heating loads 18 placed on the peripheral regions of the trays 17. Since the hot air flows along the periphery of the heating chamber 1 before it reaches the middle region, it gradually loses some of its heat, producing a difference in the heating degree between the peripheral and middle regions. Further, if heating loads 18 of substantial height are placed around the periphery, they form an obstacle which makes it difficult for the hot air to flow to the middle region, so that the latter is less heated. Since the trays 17 are rotated, there is less difference in the degree of heating between the heating loads placed around the periphery.

It is seen from the above that with the conventional cooking appliance of the hot air circulation type, since the heating loads 18 placed on the peripheral regions of the trays are easily subjected to the hot air at high temperature blown out of the blow-out ports 4, they are overheated and dried causing them to lose the moisture in their surfaces, become hard, while the heating loads 18 placed on the middle regions are subjected to hot air at lower temperature, resulting in insufficient heating which makes them washy and tasteless. Thus, there has been a large difference in the degree of heating between the middle and peripheral regions.

SUMMARY OF THE INVENTION

With such background in mind, the present invention provides a cooking appliance of the hot air circulation type designed to avoid local drying of heating loads and uneven heating in the heating chamber.

To achieve the above object, the invention provides a cooking appliance comprising a heating chamber for receiving a heating load, a heating device for heating said heating chamber, a compartment adjacent to said heating chamber, a fan stored in said compartment for circulating hot air through said heating chamber and said compartment, a partition plate separating said compartment from said heating chamber and having blow-out ports and suction ports for circulating said hot air, a control wall disposed adjacent the blow-out ports of said partition plate for controlling the blowing direction of said hot air, a bypass passage for said hot air disposed adjacent the blow-out ports for said control wall, and a control plate for hot air disposed at the section for blowing out hot air into said heating chamber, such control plates being positioned above or below said blow-out ports or at vertically spaced positions.

According to the above arrangement, the hot air is blown out along the control wall and the blow-out direction of the hot air is set substantially to the middle of the heating chamber and can be controlled upwardly or downwardly and horizontally by the control plate. Thus, the heating loads can be divided according to the blow-out ports. Therefore, local drying of the heating loads can be avoided and the heat distribution in the middle and periphery can be made uniform, facilitating a design for balance of heat quantity in the top and bottom surfaces of the heating loads and in the upper and lower stages so as to enable balanced heating of heating loads on the upper and lower stages with less uneven heating.

DESCRIPTION OF THE PREFERRED EMBODIMENT

Figure 1:
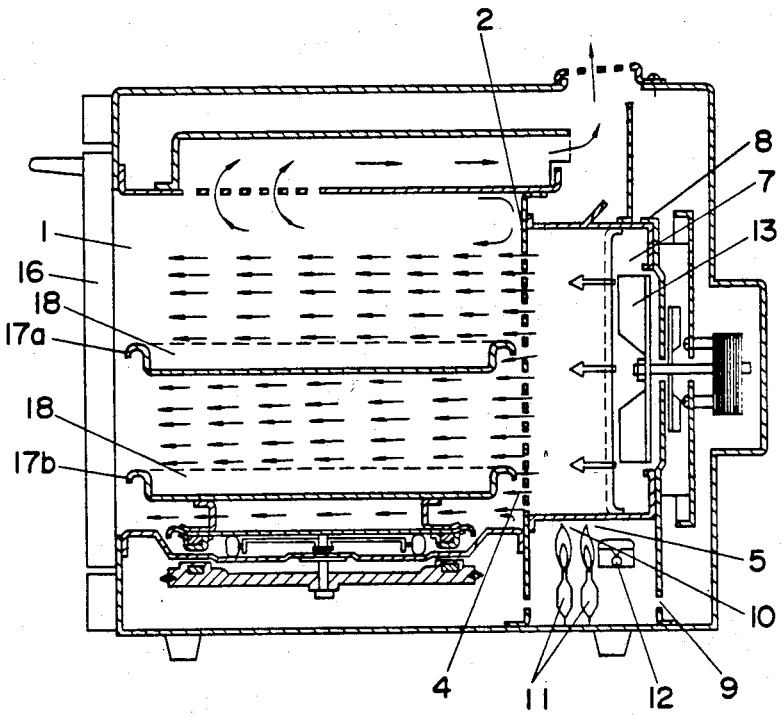
FIG. 1 PRIOR ART
FIG. 1 is a side sectional view of a conventional cooking appliance.
Figure 2:
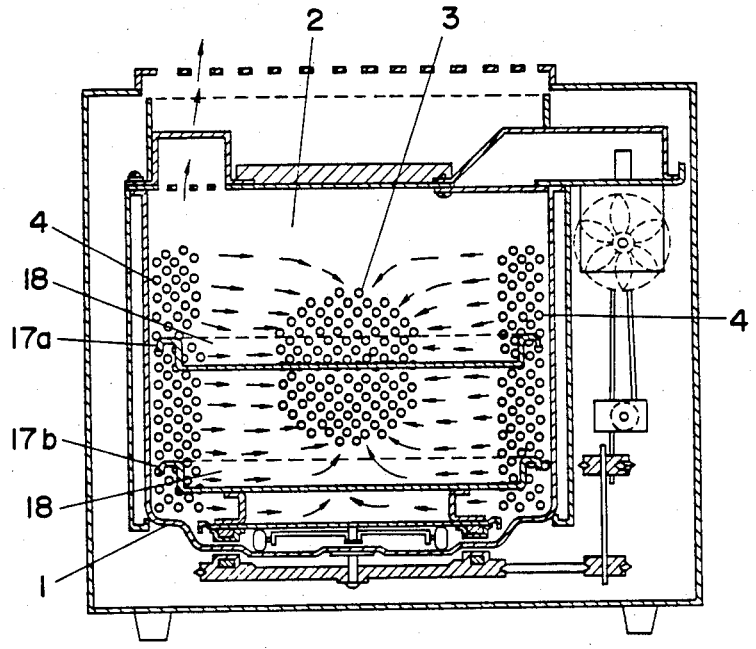
FIG. 2 PRIOR ART
FIG. 2 is a front sectional view of said appliance.
Figure 3:
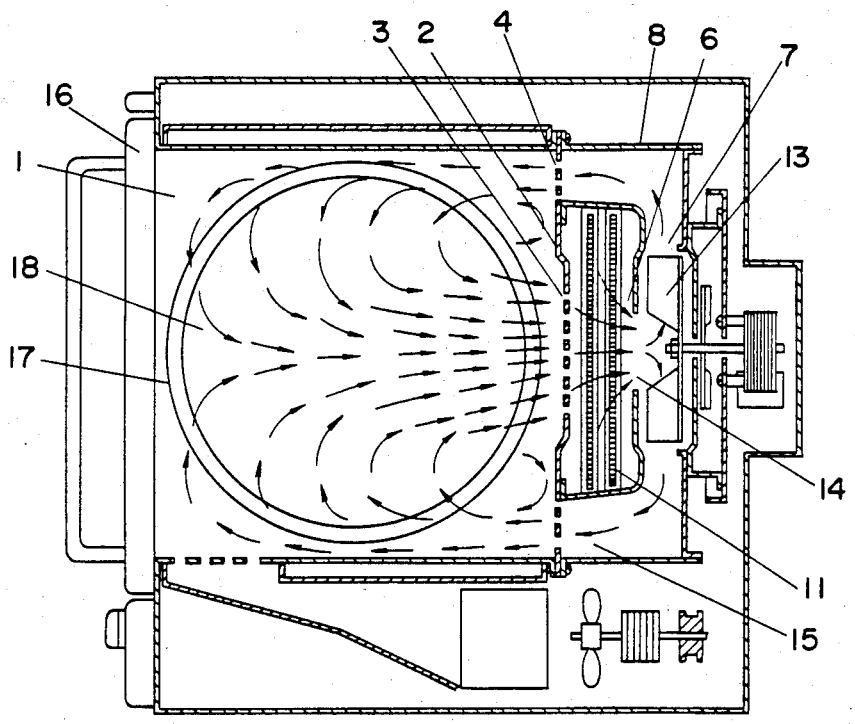
FIG. 3 PRIOR ART
FIG. 3 is a plan sectional view of said appliance.

An embodiment of the invention will now be described with reference to the drawings.

In FIGS. 4 through 11, a main body 19 has a heating chamber 1 for cooking heating loads 18. The front opening in the heating chamber 1 is provided with a door 16. The upper wall of the heating chamber 1 is provided with an electric power supply port 20 connected to a magnetron 21, which is a high frequency wave generator, and a waveguide 22 for radiating high frequency waves into the heating chamber 1. The electric power supply port 20 is covered with a cover 23 of dielectric material to prevent entry of food refuse and 1 water vapor into the waveguide 22. Placed on the bottom wall of the heating chamber 1 is a magnetically driven turntable 24, on which a rotatable tray 17 is placed. The turntable 24 is driven by a cooling fan motor 25 having a motor shaft 26 carrying thereon a pulley 27 which drives, through a belt 28, a pulley 30 mounted on a worm gear 29 having an output shaft 31 carrying thereon a pulley 32 which drives a pulley 34 through a belt 33, said pulley 34 having a pulley 36 mounted on a pulley shaft 35, so that the pulley 36 is driven. The pulley 36 drives, through a belt 37, a pulley 38 mounted on the outer surface of the bottom wall of the heating chamber 1. When the pulley 38 is thus rotated, a magnet 39 mounted on the pulley 38 is rotated. The magnet 39 attracts a magnet 40 on the lower surface of the turntable 24, so that the latter, supported by roller 41, is rotated. Moreover, the bottom wall of the heating chamber 1 and a metal plate 42 on which the magnet is installed are formed of a stainless steel, aluminum or other nonmagnetic metal plate to allow passage of magnetic flux.

A cooling fan 43 mounted on one end of the motor shaft 26 of the cooling fan motor 25 cools the magnetron 21. The air, after being used for cooling, passes through an air guide 44, most of the air passing through an opening in the upper wall of the air guide 44 and then a space between the outer surface of the upper wall of the heating chamber 1 and the upper wall of the main body 19 and being discharged through an exhaust cover 45. Part of the air enters the heating chamber 1 through holes 46 punched in a side wall of the heating chamber 1 and then passes through an exhaust guide 48 connected to exhaust holes 47 in the upper wall of the heating chamber 1 and then through the exhaust cover 45 to be discharged outside. The outer surface of the upper wall of the heating chamber 1 is provided with a heat insulator 49 and the outer surface of the side wall of the heating chamber 1 is provided with a heat insulating plate 50.

Figure 7:
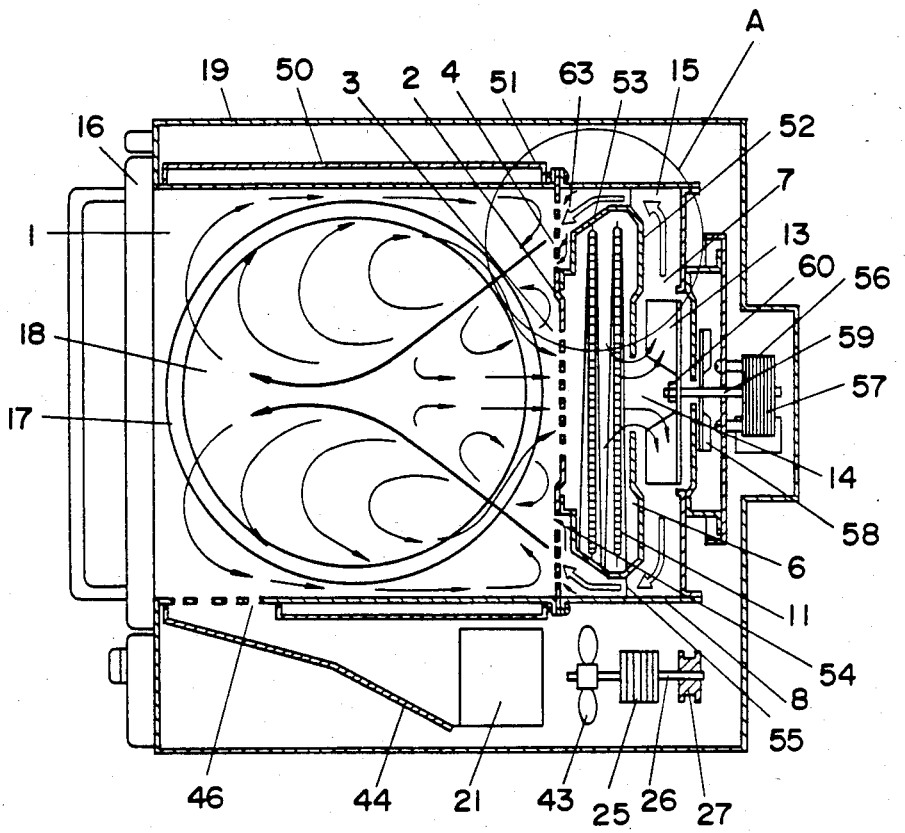
FIG. 7 is a plan sectional view of said appliance, showing the flow of hot air in the vicinity of the underside of a lower stage tray.
Figure 8:
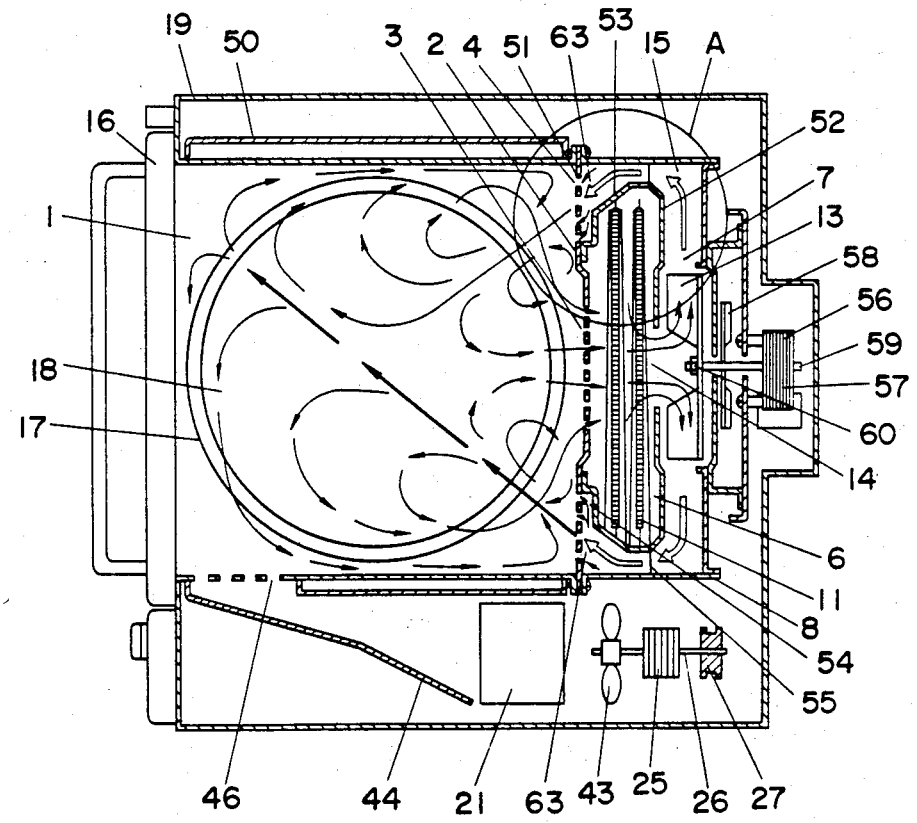
FIG. 8 is a plan sectional view of said appliance, showing the flow of hot air in the vicinity of the underside of an upper stage tray and the flow of hot air in the vicinity of the upperside of the upper stage tray.
Figure 9:
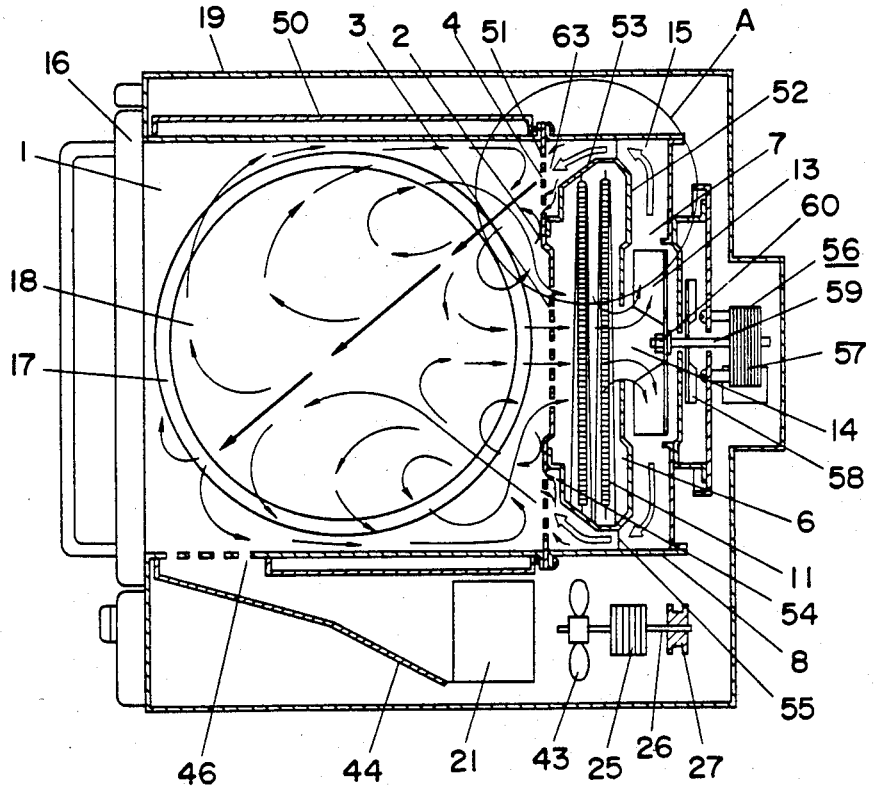
FIG. 9 is a plan sectional view of said appliance, showing the flow of hot air in the vicinity of the upperside of the upper stage tray and in the vicinity of the upper wall of the heating chamber.
Figure 10:
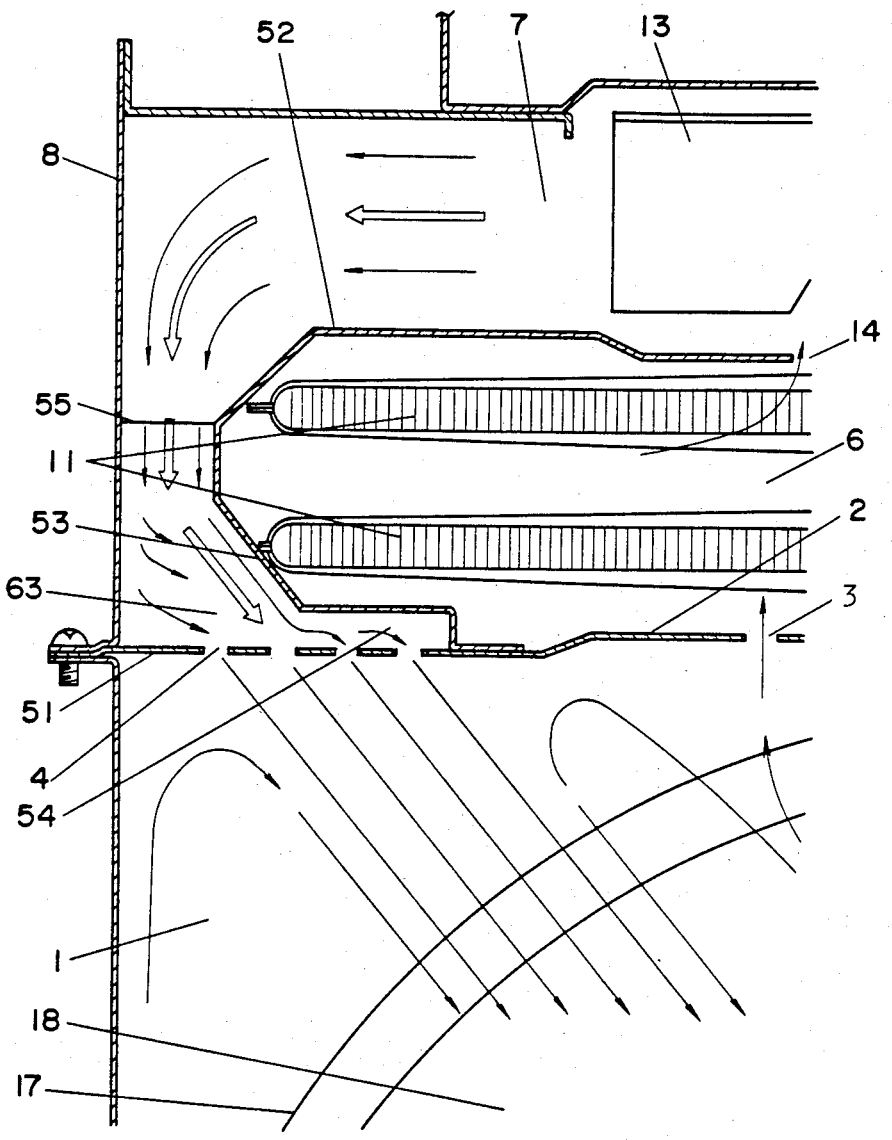
FIG. 10 is an enlarged plan sectional view of a portion A of FIG. 9.
Figure 11:
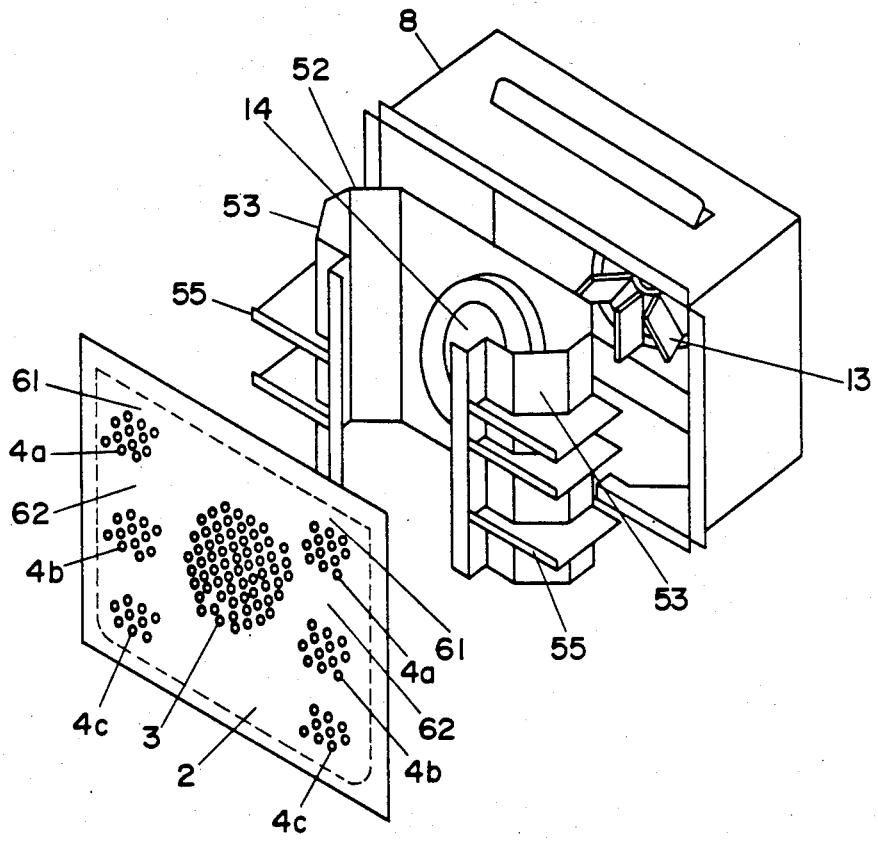
FIG. 11 is an exploded perspective view of the principal portion of said appliance.

In FIGS. 7 through 9, suction ports 3 are provided substantially in the middle of the back of the heating chamber 1 and the right and left peripheral regions are provided with a barrier wall 51, which is associated with blow-out ports 4, and there is provided a compartment 8 having a partition plate 2 having the blow-out ports 4 in the form of punched holes divided into three groups (upper blow-out ports 4*a*, middle blow-out ports 4*b*, and lower blow-out ports 4*c*), a combustion chamber 5, a circulation air heating chamber 63 and a circulation fan storing chamber 7. The heating chamber 1 and com- partment 8 are separate from each other, said compartment 8 being attached to the back of the heating chamber 1 by screws. The combustion chamber 5 is positioned below the compartment 8 and the lower portion of the peripheral wall is provided with an inlet port 9 for combustion air and the top wall is formed with a combustion gas passage 10 opening to a circulation airheating chamber 63, with two main burners 11 and a single pilot burner 12 installed therein. The circulation air heating chamber 63 is formed so that its partition wall 52 surrounds the suction ports 3 of the partition plate 2, and suction ports 14 are formed in opposed relation to a circulation fan 13 installed in the circulation fan storing chamber 7. The right and left side walls of the circulation fan storing chamber 7 and the partition wall 52 extend to the partition plate 2. The portion of the partition wall 52 in the vicinity of the partition plate 2 is provided with a control wall 53, and a bypass passage 54 is defined between the control wall 53 and the partition plate 2, forming a blow-out line 15 having a control plate 55 for controlling hot air in the hot air blow-out section communicating with the blow-out ports 4 (upper blow-out ports 4*a*, middle blow-out ports 4*b* and lower blow-out ports 4*c*) and the heating chamber 1.

A fan device 56 comprises a circulation fan 13, a circulation fan motor 57 for driving the circulation fan 13, a self-cooling fan 58 for cooling the circulation fan motor 57, and a circulation fan storing chamber 7 serving as a casing, said circulation fan 13 being removably attached to a circulation fan motor shaft 59 by a fan attaching screw 60.

In the above arrangement, the hot air flowing out of the heating chamber 1 through the suction ports 3 formed substantially in the middle of the partition plate 2, and the combustion gas at high temperature from the main burners 11 and pilot burner 12 passing through the combustion gas passage 10 flow into the circulation air heating chamber 6, from which they are drawn out by the circulation fan 13 to flow into the blow-out line 15. The two hot flows are sufficiently mixed by the combining and mixing action in this suction and blow-out process and by the stirring action of the circulation fan 13 to provide hot air at high temperature having no unevenness in temperature.

The hot air at high temperature flows along the side walls of the circulation fan storing chamber 7, as shown in FIGS. 7 through 10, but the provision of the barrier wall 51 in the right and left peripheral regions results in a higher pressure at the barrier wall 51, while the portion of the partition wall 52 corresponding to the barrier wall 51 is provided with a bypass passage 54 communicating with the heating chamber 1. As a result, the pressure in the bypass passage 54 is lower than the pressure at the barrier wall 51. Thus, the hot air at high temperature flows along the control wall 53 forming a portion of the partition wall 52 and is blown out substantially to the middle (with respect to the horizontal plane) of the heating chamber 1.

Figure 4:
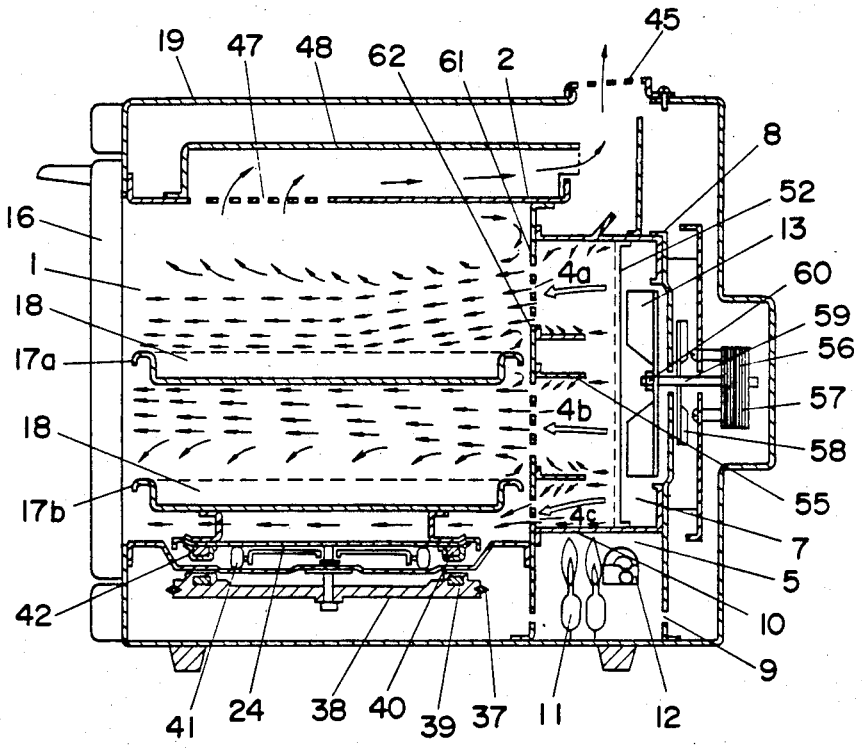
FIG. 4 is a right-hand side sectional view of a cooking appliance showing an embodiment of the present invention.
Figure 5:
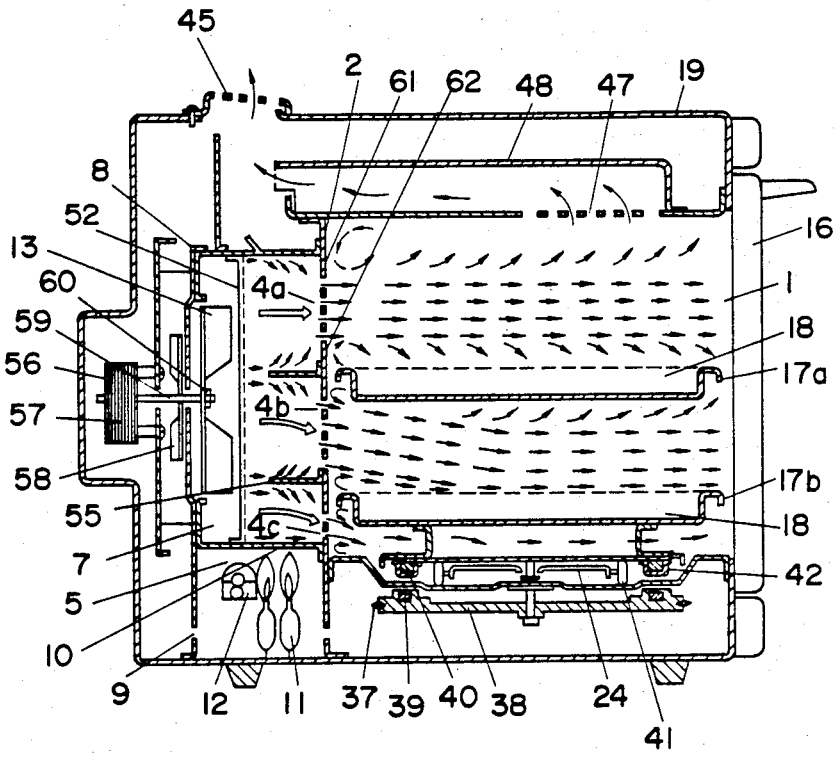
FIG. 5 is a left-hand side sectional view of said appliance.
Figure 6:
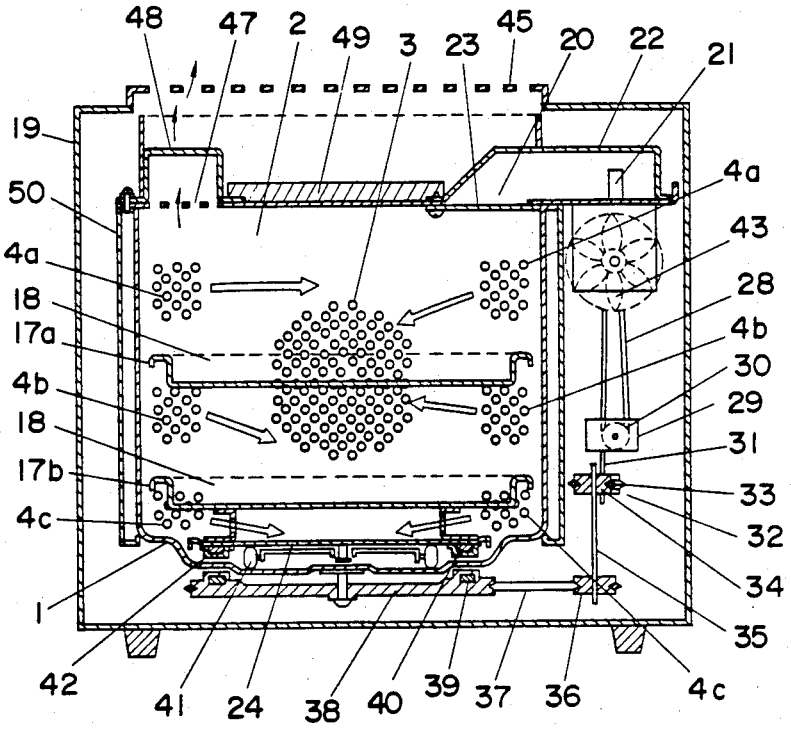
FIG. 6 is a front sectional view of said appliance.

As shown in FIGS. 4 and 5, the section for blowing out the hot air from the compartment 8 into the heating chamber 1 is provided with control plates 55 for the hot air, such control plates 55 being positioned above and below said blow-out ports 4 or vertically spaced positions, whereby an upper barrier wall region 61 and a lower barrier region 62 are defined between the blow-out ports 4 and a control plate 55, and the pressures at the upper and lower barrier wall regions 61 and 62 are higher than the pressure in the blow-out ports 4 and approximately proportional to the length of the upper and lower barrier wall regions 61 and 62. Thus, by changing the length of the upper and lower barrier wall regions 61 and 62, it is possible to produce a difference between the pressures in said regions. Thus, the hot air is deflected from the higher pressure side, i.e., the longer barrier wall, to the lower pressure side, i.e., the shorter barrier wall. As shown in FIG. 4, since the upper barrier wall region 61 is longer than the lower barrier wall region 62, the hot air blown out of the upper blow-out ports **4*a* on the right-hand side is deflected downwardly and at the same time it is blown out substantially to the middle (with respect to the horizontal plane) to heat the heating load 18 placed on the upper stage tray 17, striking the door 16, with part of said hot air being circulated and part being sucked through the suction ports 3. As shown in FIG. 4 5, since the upper barrier wall region 61 is equal in length to the lower barrier wall region 62, the direction of the hot air blown out of the upper blow-out ports 4*a* on the left side is horizontal, and as shown in FIG. 9 it is blown out substantially to the middle of the heating chamber 1, heating the upper region of the heating chamber 1 to make up for the heat of which the upper wall of the heating chamber 1 is deprived, while heating the heating load 18 placed on the upper stage tray 17 in a well-balanced manner to prevent the heating load from being deprived of its heat, and it strikes the door 16 on the front surface. Part of the hot air is circulated and part is sucked through the suction ports 3. Part flows through the exhaust ports 47 of the upper wall of the heating chamber 1 into the exhaust guide 48 and then through the exhaust cover 45 to be discharged outside. As shown in FIG. 4, since the upper barrier wall region 61 is shorter than the lower barrier wall region 62, the hot air blown out of the middle blow-out ports 4*b* on the right-hand side is deflected upwardly. At the same time, it is blown out substantially to the middle of the heating chamber 1, as shown in FIG. 8, heating the bottom of the upper stage tray 17*a* while striking the door 16, with part of the hot air being circulated and part being sucked through the suction ports 3**.

As shown in FIG. 5, since the upper barrier wall region 61 is longer than the lower barrier wall region 62, the hot air blown out of the middle blow-out ports **4*b* on the left-hand side is deflected downwardly. At the same time, as shown in FIG. 9, it is blown out substantially to the middle (with respect to the horizontal plane), heating the heating load 18 placed on the lower stage tray 17*b*, while striking the door on the front surface, with part of the hot air being circulated and part being sucked through the suction ports 3. As shown in FIGS. 4 and 5, since the upper barrier wall region 61 is longer than the lower barrier wall region 62, the hot gas blown out of the lower blow-out ports 4*c* on the right and left sides is deflected downwardly. At the same time, as shown in FIG. 7, it is blown out substantially to the middle of the heating chamber 1, heating the bottom of the lower stage tray 17*b* while making up for the heat of which the bottom surface of the heating chamber 1 is deprived, thus effecting balanced heating, and striking the door 16 on the front surface, with part of the hot air being circulated and part being sucked through the suction ports 3**.

Thus, according to this embodiment, since the blow-out section 63 for blowing out the hot air from the compartment 8 into the heating chamber 1 is provided with the barrier wall 51, the pressure at the barrier wall 51 is high. The portion of the partition wall 52 corresponding to the barrier wall 51 is provided with the blow-out ports 4 and the bypass passage 54 communicating with the heating chamber 1. As a result, the pressure in the bypass passage 54 is lower than the pressure at the barrier wall 51. Thus, the hot air at high temperature flows along the control wall 53 forming a portion of the barrier wall 52 and is blown out substantially to the middle (with respect to the horizontal plane) of the heating chamber 1. Further, the section 63 for blowing out the hot air from the compartment 8 into the heating chamber 1 is provided with the control plates 55 for the hot air, such control plates 55 being positioned above or below the blow-out ports 4 or vertically spaced positions, whereby the upper and lower barrier wall regions 61 and 62 are formed between the blow-out ports 4 and the control plate 55. The pressure at the upper and lower barrier wall regions 61 and 62 are higher than the pressure at the blow-out ports 4 and are approximately proportional to the length of the barrier wall. As a result, by changing the length of the upper and lower barrier wall regions 61 and 62, it is possible to produce a difference in pressure above and below the blow-out ports 4. Thus, it is possible to deflect the hot air from the higher pressure region, i.e., the longer barrier wall, to the lower pressure region,i.e., the shorter barrier wall. By changing the length of the barrier wall 51, i.e., the position of the control plate 55, the blowing direction of the hot air can be changed as desired. Thus, there is no possibility that the hot air blown out of the blow-out ports 4 is concentrated to locally strongly heat the heating load 18, while it is possible to intensify the weak heating, thus ensuring balanced cooking on the upper and lower stages and of the front bottom surfaces of the heating load 18, and preventing the heating load 18 from being locally dried with the moisture of the front surface evaporated to become hard and tasteless.

The upwardly or downwardly deflected hot air from the blow-out ports 4 gradually spreads while mixing with the hot air in the heating chamber 1, and the hot air in the vicinity of the heating load 18 has less variation in temperature; thus, the hot air which is uniform in temperature throughout heats the heating loads 18 while wrapping the latter and then flows to the suction ports 3 formed substantially in the middle of the partition plate 2. Further, since the trays 17 are formed of metal, their heat conductivity is high, accelerating the rate of which the temperature of the trays 17 and the temperature of the atmosphere are made uniform, and since the trays are rotated, cooking is possible which is free of uneven heating and local drying and the menus which have heretofore been accompanied with uneven heating have been much improved in the present embodiment, as shown in the following table.

TABLE

| | Oven menu | Prior art | Present embodiment |
|---|---|---|---|
| Low and medium temperature cooking | Cookie | O | ◎ |
| | Big cake | Δ~O | O~◎ |
| | Sponge cake | O | ◎ |
| | Custard pudding | ▮ | ◎ |
| | Cream puff | Δ | O~◎ |
| | Butter roll | Δ~O | O~◎ |
| | Pound cake | O | ◎ |
| | Apple pie | Δ | ◎ |
| High temperature cooking | Macaroni gratin | O | ◎ |
| | Hamburger | Δ | O~◎ |
| | Dark meat | O | O~◎ |
| | Roast pork | ▮~Δ | O~◎ |
| | Roast chicken | Δ~O | ◎ |
| | Mackerel broiled with salt | ▮ | O |

◎Very good
O Good
Δ Fairly good
▮ Rather bad

INDUSTRIAL APPLICABILITY

As has been described so far, according to the present invention, the blowing direction of hot air is set substantially to the middle of the heating chamber and controlled as desired so that it is upward, downward or horizontal, thus avoiding local drying of the heating load and making uniform the heat distribution of the middle and periphery, and facilitating a design for balance of heat quantity in heating the front and bottom surfaces of the heating loads at the upper and lower stages, so that the heating load is heated in a well-balanced manner and cooking with less uneven heating is possible.

The above refers to a cooking appliance equipped with a high frequency heating device, but it goes without saying that the results are the same whether it is not equipped with a high frequency heating device or it is an electric cooking appliance. While two-stage cooking taken up as an embodiment has been described, the invention is applicable equally to single-stage cooking or three-stage cooking.

What is claimed is:

1. A cooking appliance comprising a heating chamber for storing a heating load;

a heating device for heating said heating load in said heating chamber;

a compartment adjacent said heating chamber;

fan means accommodated in said compartment for circulating hot air through said heating chamber and said compartment;

blow-out means for conducting into said heating chamber hot air which has been circulated by said fan means;

a partition plate separating said heating chamber from said compartment, said partition plate having blow-out ports defined by a multiplicity of openings divided into a plurality of groups disposed near the right and left ends of said partition plate;

a plurality of spaced substantially horizontal control plates partitioning said blow-out line means thereby separating the air reaching each of said groups of blow-out ports; and barrier wall means abutting against each of said control plates and extending in the vertical direction from said blow-out ports, the ratio of the lengths of the portions of said barrier wall means above and below said blow-out ports being varied to control the blowing direction of hot air in the vertical direction.

2. A cooking appliance comprising a heating chamber for storing a heating load;

a heating device for heating said heating load in said heating chamber;

a compartment adjacent said heating chamber;

fan means accommodated in said compartment for circulating hot air through said heating chamber and said compartment;

blow-out line means for conducting into said heating chamber hot air which has been circulated by said fan means;

a partition plate separating said heating chamber from said compartment, said partition plate having blow-out ports defined by a multiplicity of openings divided into a plurality of groups disposed near the right and left ends of said partition plate;

control wall means inclined relative to said partition plate in the vicinity of the ends of said blow-out line means and extending toward the center of said heating chamber;

bypass means extending from said control wall means to cover a portion of said blow-out ports; and barrier wall means disposed in facing relationship with said control wall means on the side of said heating chamber away from that portion of said control wall means into which hot air flows, said barrier wall means deflecting hot air along said control wall means, whereby said hot air is caused to flow toward the center of said heating chamber which is located on the extension of said inclined control wall means.

3. A cooking appliance comprising a heating chamber for storing a heating load;

a heating device for heating said heating load in said heating chamber;

a compartment adjacent said heating chamber;

fan means accommodated in said compartment for circulating hot air through said heating chamber and said compartment;

blow-out line means for conducting into said heating chamber hot air which has been circulated by said fan means;

a partition plate separating said heating chamber from said compartment;

control wall means inclined relative to said partition plate in the vicinity of the ends of said blow-out line means and extending toward the center of said heating chamber; and barrier wall means disposed in facing relationship with said control wall means on the side of said heating chamber away from that portion of said control wall means into which hot air flows, whereby hot air is caused to flow toward the center of said heating chamber which is located on the extension of said inclined control wall means.

4. A cooking appliance comporising a heating chamber for storing a heating load;

a heating device for heating said heating load in said heating chamber;

a compartment adjacent said heating chamber;

fan means accommodated in said compartment for circulating hot air through said heating chamber and said compartment;

blow-out line means for conducting into said heating chamber hot air which has been circulated by said fan means;

a partition plate separating said heating chamber from said compartment;

blow-out ports divided into a plurality of groups disposed near the right and left enda of said partition plate;

a pluratliy of spaced substantially horizontal control plates partitioning said blow-out line means thereby separating the air reaching each of said groups of blow-out ports; and barrier wall means abutting against each of said control plates and extending in the vertical direction at least above said blow-out ports, the ratio of the lengths of the portions of said barrier wall means above and below said blow-out ports being varied to control the blowing direction of hot air in the vertical direction.

* * * * *